US009347250B1

(12) United States Patent
Metcalf

(10) Patent No.: US 9,347,250 B1
(45) Date of Patent: May 24, 2016

(54) UNIVERSAL HINGE ALIGNMENT FIXTURE

(71) Applicant: Leslie A. Metcalf, Woodruff, SC (US)

(72) Inventor: Leslie A. Metcalf, Woodruff, SC (US)

( * ) Notice: Subject to any disclaimer, the term of this patent is extended or adjusted under 35 U.S.C. 154(b) by 338 days.

(21) Appl. No.: 13/903,476

(22) Filed: May 28, 2013

(51) Int. Cl.
*E05D 11/00* (2006.01)

(52) U.S. Cl.
CPC ..... *E05D 11/0009* (2013.01)

(58) Field of Classification Search
CPC ..... B25B 27/00; B25B 27/14; B23K 37/0408
See application file for complete search history.

(56) References Cited

U.S. PATENT DOCUMENTS 2,965,972 A 12/1960 Hunt
4,686,769 A 8/1987 Rock et al.
5,573,229 A * 11/1996 Lycan ..... B23K 37/0533 269/43
5,671,538 A 9/1997 Lautenschlager
5,950,294 A * 9/1999 Gibbs ..... B25B 27/0035 269/199
6,468,007 B2 10/2002 Coleiro
7,055,230 B2 * 6/2006 Wu ..... B25B 27/0035 29/271
D547,680 S 7/2007 King
7,299,554 B2 11/2007 Klonowski, III
8,419,000 B2 * 4/2013 St. John ..... B25B 11/00 118/500
2014/0283359 A1 * 9/2014 DePietro ..... E02D 29/12 29/466

* cited by examiner

*Primary Examiner* — Lee D Wilson
(74) *Attorney, Agent, or Firm* — Southeast IP Group, LLC.; Thomas L. Moses

(57) ABSTRACT

A universal hinge alignment fixture for mounting different types of hinges to a cabinet have a cabinet box opening is disclosed comprising a fixture plate and a grip for holding the fixture plate during use. A detachable hinge plate mount is carried by the fixture plate for affixing different types of hinge plates to the fixture plate to operate with different types of hinges. A face plate is carried by the fixture plate for engaging a face of the cabinet surrounding the cabinet box opening and spacing the door and cabinet for alignment and attachment.

19 Claims, 4 Drawing Sheets

UNIVERSAL HINGE ALIGNMENT FIXTURE

BACKGROUND OF THE INVENTION

The invention relates to a hinge alignment fixture for locating a hinge mounting plate in an alignment with a hinge on a cabinet.

BACKGROUND OF THE INVENTION

In the art of cabinetmaking, particularly custom cabinetmaking, the cabinets are typically made at the cabinet shop and transported to the place of installation without the doors attached. Still, some cabinetmakers choose to attach the doors in the cabinetmaker's shop. Transporting the cabinets without the doors attached reduces the chance of the cabinet doors being damaged during transportation. In this case, the cabinet door hinges are affixed to the cabinet doors in the shop, but the mounting plates for attaching the door hinges to the cabinets are mounted at the place of installation. In the usual procedure, the distance of the door hinge from the top of the cabinet door is measured and this measurement is marked on the cabinet box opening at the proper location using a tape measure or scale. The remaining door hinges are mounted the same way. This manual installation method is quite time consuming and if the marking is not exact, the cabinet door will be out of alignment and have to be reinstalled.

Devices have been known to aid in installing cabinet hinges such as shown in U.S. Pat. No. 4,686,769. In this patent, a marking gauge is provided for marking the location of hinges and mounting plates for the hinges. The gauge is used to mark holes for the mounting plate, and the mounting plate is attached by wood screws. A hinge is then inserted into the mounting plate, and the screw holes are marked on the door for the hinges which are then mounted on the door.

U.S. Pat. Nos. 5,671,538 and 7,299,554 82 disclose mounting tools for cabinets and doors which include a general U-shaped member that grips the edge of the box opening so that a mounting plate of the hinge may rest on top of the tool in a desired location. The screw holes are then marked, the mounting tool removed, and the mounting plate attached by screws.

Design Pat. 0547,680 S discloses a design of a hinge template. U.S. Pat. No. 6,468,007 82 discloses a hinge jig of general interest.

Thus, the provision of an adjustable hinge alignment fixture that can easily be set for locating mounting plates for a variety of hinges, and when the hinge has already been affixed to the door, is a problem that needs to be met.

Accordingly, an object of the present invention is to provide a universal hinge alignment fixture which can be used to mount a number of different types of hinges to cabinets, eliminating measuring the marking all together.

Another object of the invention is to provide a hinge alignment fixture which provides for quick and easy location of a mounting plate carried by the hinge alignment fixture and be adjustable in its position to align many different cabinet applications.

Yet another object of the present invention is to provide a hinge alignment fixture upon which a hinge and mounting plate can be affixed to the fixture and adjustable cabinet slide stops may be utilized to set the desired distance between the top or bottom of the cabinet opening and the mounting plate in a quick and easy manner.

Still another object of the present invention is to provide a simple and reliable door alignment hinge fixture which can be held by one hand while a hinge and mounting plate are held by the fixture so that the mounting plate may be screwed in place while held by the fixture using a power drill and the like.

SUMMARY OF THE INVENTION

The above problems have been overcome by providing a universal hinge alignment fixture for mounting one or more different types of hinges to a cabinet having a cabinet door and a cabinet box opening. The hinge alignment fixture comprises a fixture plate, and a hinge plate carried by the fixture plate for attaching one of a number of different types of hinges to the fixture plate. A face plate is carried by the fixture plate for engaging a face of the cabinet surrounding the cabinet box opening. The face plate includes a pair of face stops for engaging the face of the cabinet box, and a recess defined between said face stops for receiving edges of a mounting plate which is carried by the door hinge, and hence the fixture, is mounted during installation. The hinge plate includes a circular cut out for receiving a cup of the hinge when mounted to the hinge plate, and the face plate includes an arcuate section which matches the circular cut on the hinge plate. The fixture plate includes adjustable slide stops carried by the fixture plate for positioning the fixture plate in a proper position on the inside of the cabinet box opening for affixing the hinge mounting plate on the cabinet box. The fixture plate includes adjusting slots for adjusting the position of said slide stops on the fixture plate, and means for setting the slide stops in the proper position for many different hinge needs.

A method is disclosed for aligning a hinge mounting plate on a cabinet which can be a frameless or face frame style cabinet. Typically the face frame style cabinet includes a cabinet box and box opening, and a cabinet face surrounding the box opening. The method comprises providing a hinge alignment fixture having a fixture plate upon which a door hinge may be mounted, a mounting plate attached to the hinge, and adjustable slide stops carried by said fixture plate. The slide stops are adjusted to align the door hinge and hinge mounting plate relative to the cabinet box opening. This fixture can be used with face frame or box/frameless cabinets.

The hinge alignment fixture with the mounting plate is moved into position with the bottom slide stop on the bottom of the door opening and the face stop is placed on the face of the cabinet. Two screws are then used to attach the mounting plate to the cabinet. The release button on the hinge is then pressed and the fixture is removed from the mounting plate. Only the bottom mounting plate is installed. By installing and aligning the cabinet bottom mounting plate mounting first, allowances are made for any variances in the door sizes since any variances will not be discernible across the bottom of the doors, and will be discernible across the tops of the doors because they are not very visible. Next, the mounting plate for the top of the cabinet opening is snapped on to the top door hinge already attached to the door. With the bottom door hinge and mounting plate attached to the bottom of the cabinet, the top door hinge and attached mounting plate are automatically aligned, and two screws are used to attach the top mounting plate and hinge. This is then repeated for the remaining door hinges.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
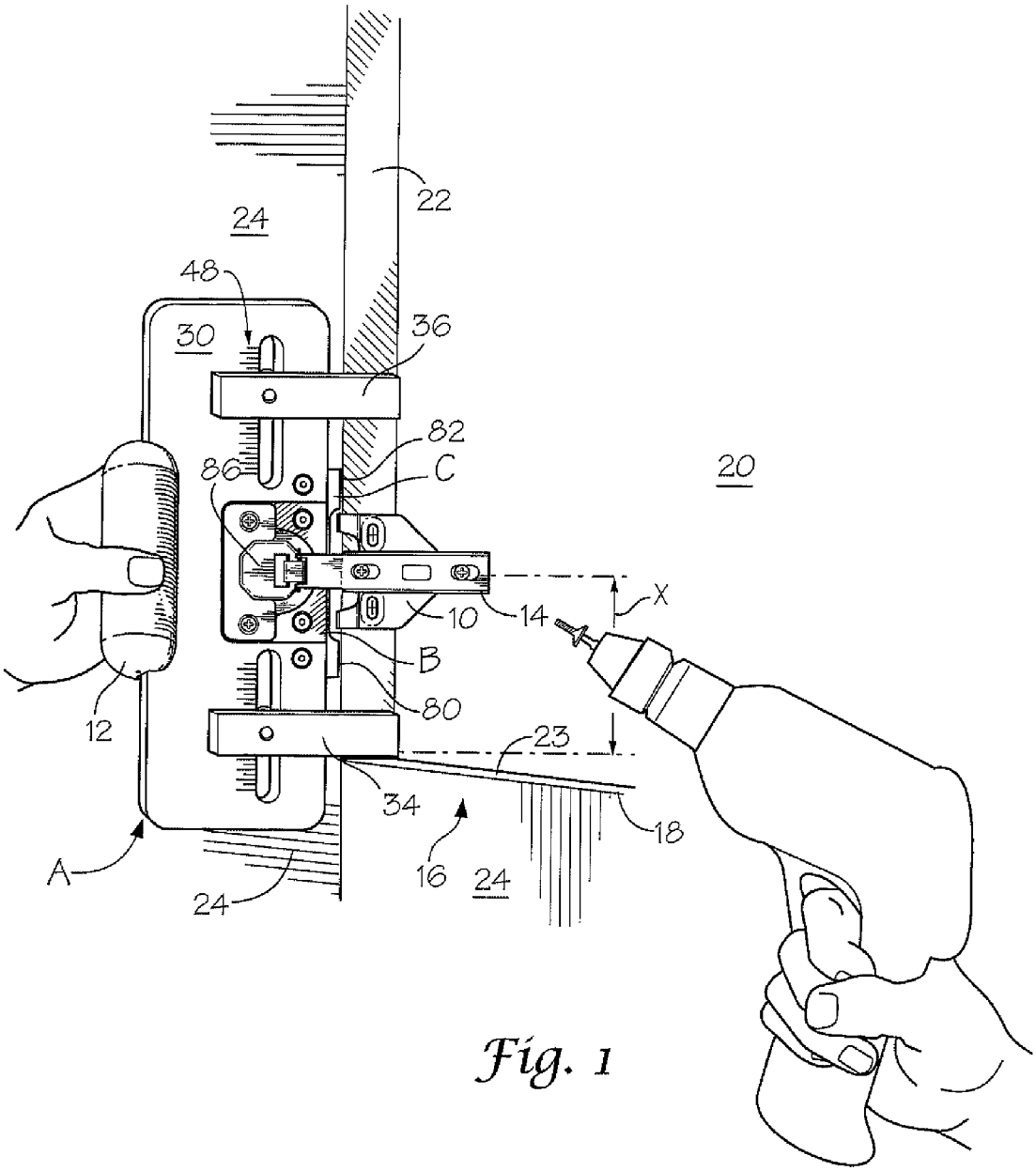
FIG. 1 is a perspective view of a hinge alignment fixture according to the invention for mounting a hinge mounting plate to a cabinet box in the bottom position.

Referring now to the drawings, the invention will be described in more detail.

FIG. 1 shows a hinge alignment fixture, designated generally as A, for aligning and mounting a hinge mounting plate 10 to a cabinet box 16. A cabinet 16 includes a cabinet box 18 and a cabinet box opening 20 having a peripheral inside edge 22. Surrounding the cabinet box opening 20 is a cabinet face 24. A cabinet door 27 closes the box opening when hinged to the cabinet box.

Referring now to FIGS. 1 through 4, the hinge alignment fixture A is illustrated as including a fixture plate 30, a handle 32, and a hinge mounting plate B. A face plate C is carried by the fixture plate 30. Hinge 14 can be mounted to the hinge plate B. In use, hinge plate B is affixed to fixture plate 30 by means of screws 18. Hinge 14 is affixed to hinge plate B by screws 18*b*, and hinge mounting plate 10 is united with hinge 14 by means of a conventional clamping mechanism (FIG. 4), or other means determined by the manufacturer. When the alignment fix is located at the proper mount position for mounting plate 10, hinges 14 on the door will be aligned. A pair of cabinet slide stops 34 and 36 are adjustably carried on fixture plate 30 by means of adjusting slide slots 38 and 40. A clamping mechanism comprises thumb screws 42 and 44 and threaded screw holes 46 and 48 for setting the slide stops. Of course, any other mechanism may be devised to allow loosening of the slide stops and sliding of the slide stops to a position in which the slide stops are clamped or tightened against fixture plate 30. In addition, scales 48 are provided for setting the cabinet stops in a proper position so that hinge 14 and hinge mounting plate 10 are carried by alignment fixture A in proper alignment for mounting to the cabinet box.

As illustrated, hinge 14 and hinge plate B are affixed by means of threaded screw openings 19 which receive screws 18.

Figures 2, 3:
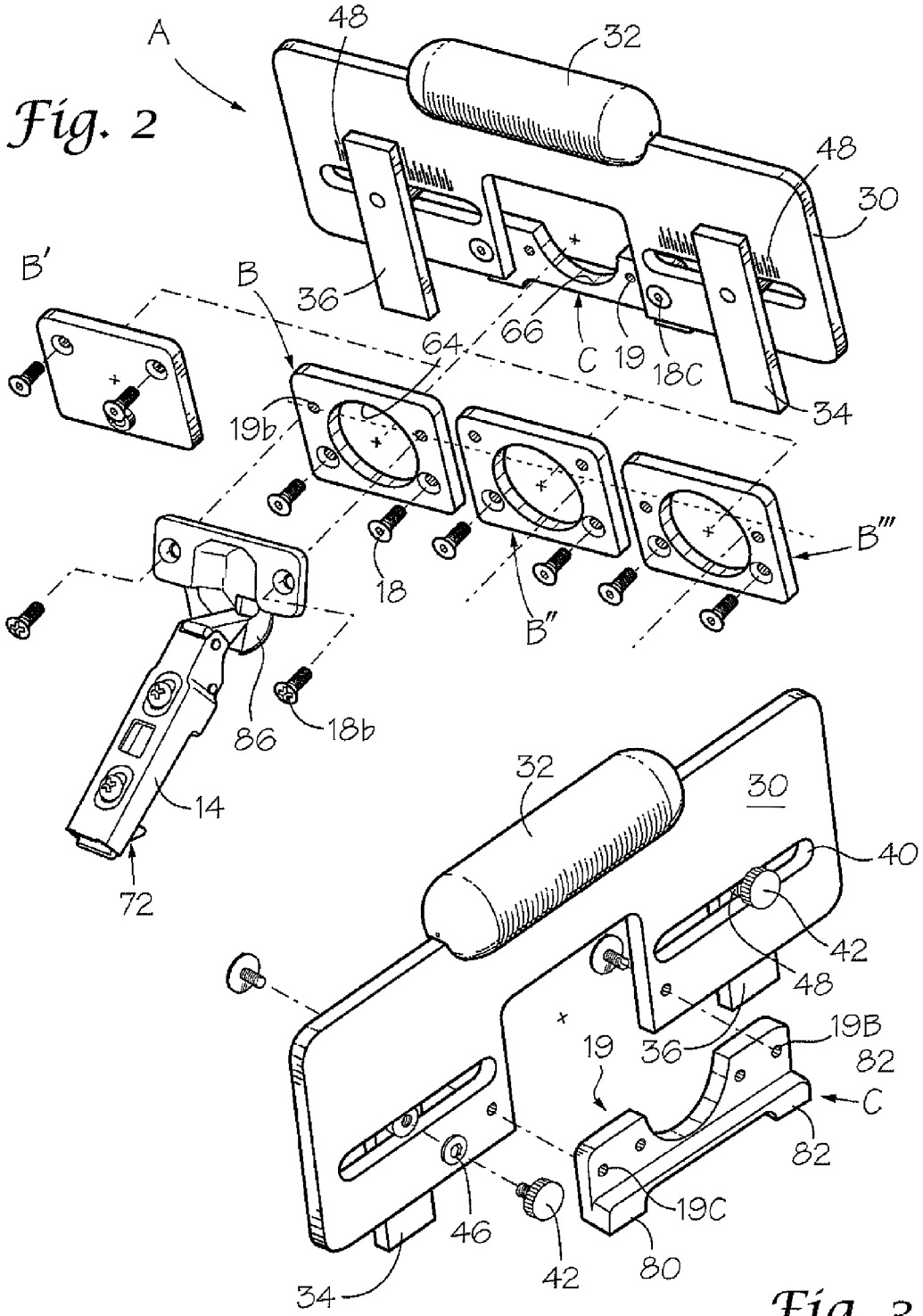
FIG. 2 is a front perspective view of a universal hinge alignment fixture constructed according to the invention with parts separated and showing use with different hinge mounting plates.
FIG. 3 is a rear perspective view of a hinge alignment fixture according to the invention.

Referring to FIG. 3, it can best be seen that face plate C includes a face plate attachment fixing face plate C and fixture plate 36 such as a threaded hole 19*c* which receives threaded screw 18*a* passing through an opening in hinge plate 30.

Figure 4:
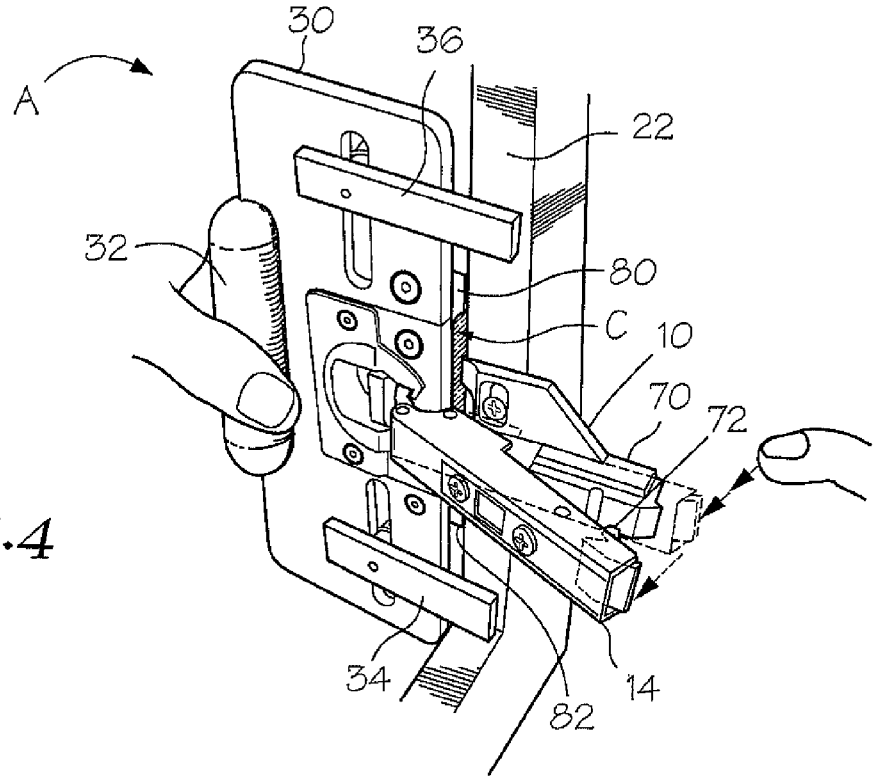
FIG. 4 is a front perspective view of a hinge alignment fixture constructed according to the invention showing unlatching of a clamping fixture and hinge from a mounting plate after the mounting plate has been fixed to the cabinet.
Figure 5:
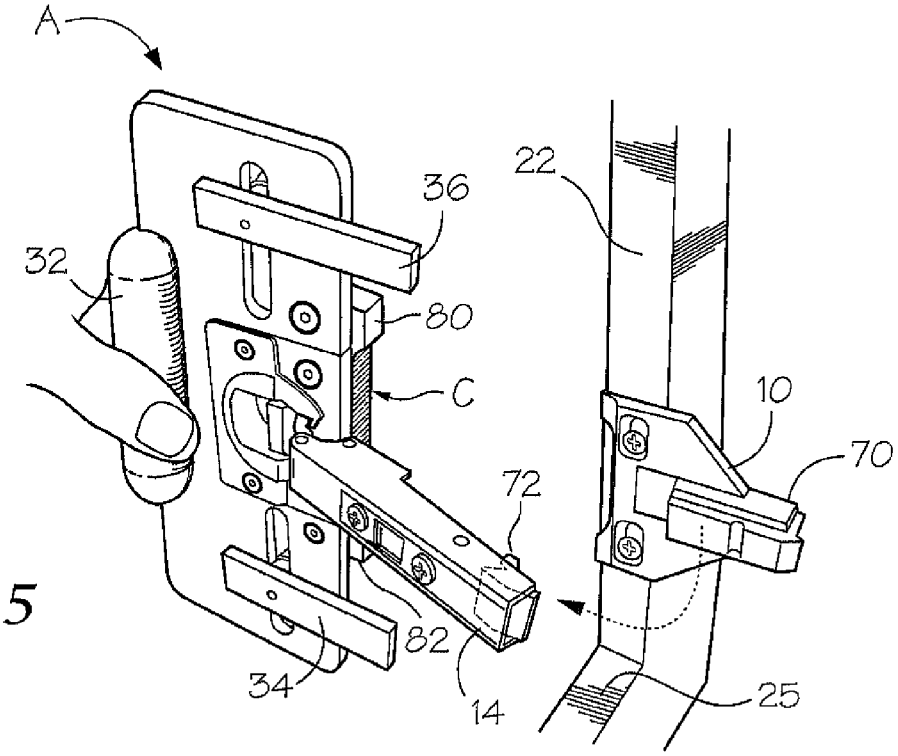
FIG. 5 is a front perspective view of a hinge alignment fixture constructed according to the invention showing complete separation of the fixture and hinge from a mounting plate after the mounting plate has been fixed to the cabinet.

Referring to FIGS. 2 and 3, it can best be seen that hinge plate B includes a circular opening 64 and that face plate C includes an arcuate section 66 whose arcuate sections match when hinge B overlies face plate C, circular 64 is not obstructed. Circle 64 receives a cup 68 of hinge 14 when mounted to the hinge plate. In use, hinge 14 is mounted on hinge plate B as a dummy or substitute hinge for carrying mounting plate 10 united with the hinge. Referring to FIGS. 4 and 5, typically the hinge and mounting plate are united together by a latch bar 70 of the mounting plate being latched with a latch arm 72 of the hinge in a conventional manner. The two pieces may be united and separated by pulling or pushing a button 74 and unlatching of the latch bar and latch arm so that the substitute hinge can be removed and the real hinge of the door may be attached. Face plate C includes at least one face stop, preferably two, 80 and 82 which engage face 24 to provide proper clearance between the door and face.

As can best be seen in FIG. 2, there are numerous different types of hinge plates B, G, H, and drill gig I shown to fit different types of hinges. Different types of hinges require different attachment holes in the hinge plate. Therefore, the attachment means described include threaded machine screws 18 having an Allen type opening for being threaded into the different threaded holes 19. Of course, other means may also be provided for attachments means as is within the skill of the average artisan. In the sense that the hinge alignment fixture may be used with different types of hinges, the fixture may be described as a universal hinge alignment fixture. Some hinge manufacturing companies, for example, are Blum, Inc. of Stanley, N.C., Grass America, Inc. of Kernersville, N.C., and Hettich America LP of Buford, Ga., etc.

Figure 7:
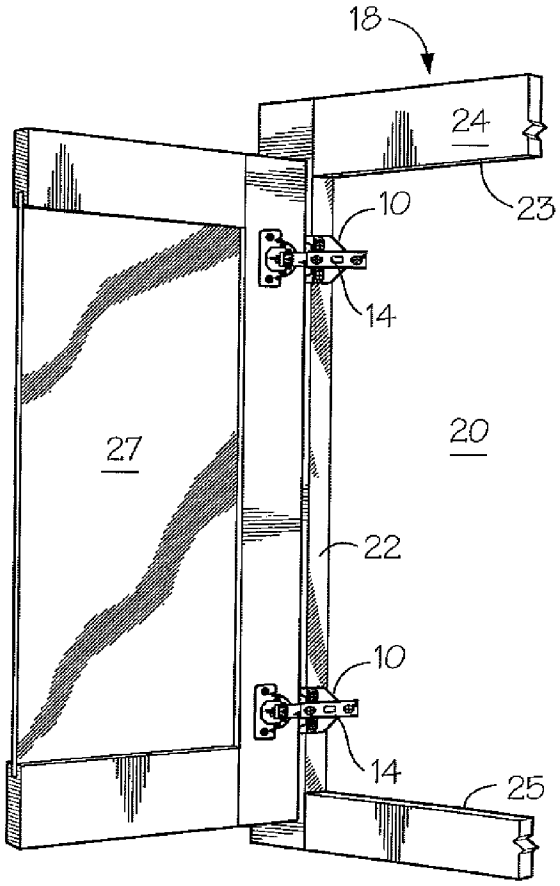
FIG. 7 is a front perspective view showing the door and hinge united with the mounting plate.
Figure 6:
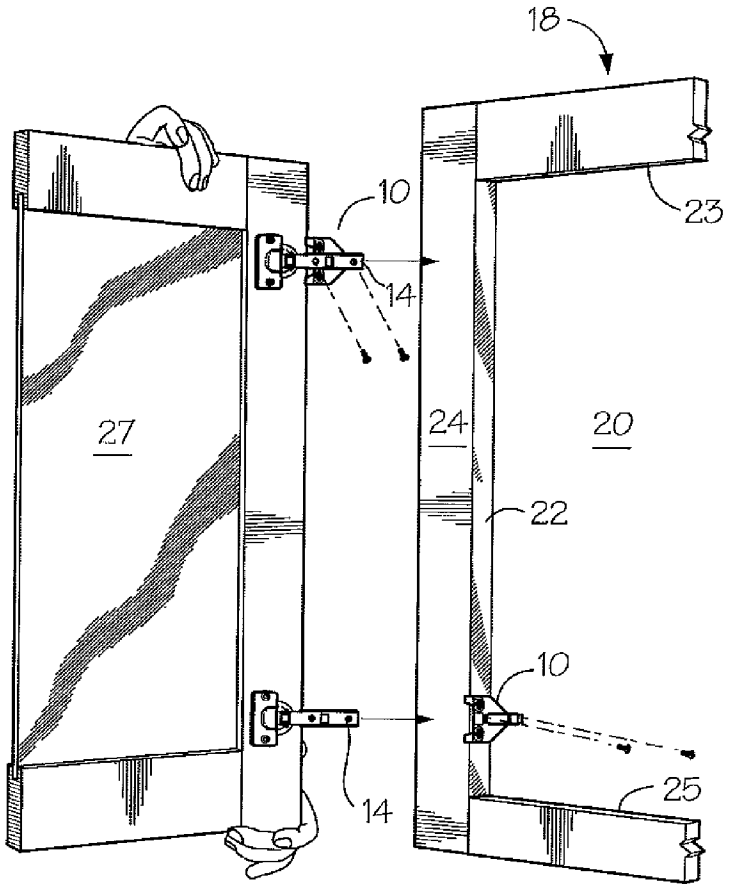
FIG. 6 is a front perspective view showing the door and hinge being united with the mounting plate.

In operation, a method is disclosed for aligning a hinge mounting plate on a cabinet wherein the cabinet includes a cabinet door, a cabinet box having an edge, and a cabinet face surrounding the cabinet box opening. In use, hinge 14 and mounting plate B are mounted to fixture plate A. Initially, the slide stop 36 is engaged against the bottom edge 23 of the box opening. Prior to setting the fixture against the cabinet, the correct spacing X between the center 86 of the hinge cup opening and slide stop 34 has been set according to the dimensions between the top or bottom of the cabinet door and the center of a circular bore, which receives the hinge cup, previously been formed in the door. Therefore, with the hinge and mounting plate carried by the fixture, and the slide stop against the bottom edge of the box opening, the mounting plate is in a proper position to either be marked or directly attached to side edge 22 of the cabinet by a power drill (FIG. 1). It may be noted that the mounting plate includes a pair of ears 88 and 100 which are flush with and slightly curved with respect to face 24 of the cabinet (FIGS. 4 and 5). It is for this reason that clearance 84 is formed between face stops of face plate C (FIG. 3). The bottom mounting plate is then screwed to the cabinet edge. The latch bar of the substitute door hinge and the latch arm of the bottom mounting plate are then unlatched and the mounting plate remains attached to the door edge in an aligned position for a real hinge 14 already affixed to the door (FIG. 6). Next, a second, upper mounting plate is attached to top door hinge 14 on the door. The real bottom door hinge is then attached to the bottom mounting plate. This aligns the top door hinge and mounting plate at the top of the cabinet. Once in position, the top mounting plate is screwed to the edge and the mounting plate and hinge remain latched together. Both upper and lower door hinges are attached to the cabinet (FIG. 7). In the event that the cabinet box opening requires two doors, the above steps are repeated for the opposite edge of the cabinet box opening wherein the face stops are reversed when fixture A is rotated 180 degrees.

Thus, it can be seen that an advantageous construction for a hinge alignment fixture can be provided according to the invention which hinge alignment is universal, i.e., different types of hinges and mounting plates that it may attached to the fixture, and the fixture is adjustable in the distance between the top or bottom of the cabinet box and the center point for the hinges by easily setting the position of the slide stops.

While a preferred embodiment of the invention has been described using specific terms, such description is for illustrative purposes only, and it is to be understood that changes and variations may be made without departing from the spirit or scope of the following claims.

What I claim is:

1. A hinge alignment fixture for locating a hinge mounting plate in an aligned position for being united with a door hinge on a cabinet door, the cabinet having a cabinet box opening with a surrounding cabinet face and a cabinet door covering the box opening comprising:

a fixture plate;

a detachable door hinge plate carried by said fixture plate for mounting a door hinge acting as a substitute hinge to said fixture plate, wherein said door hinge plate includes an attachment arrangement for attaching a door hinge acting as a substitute to said hinge plate;

a face plate carried by said fixture plate;

screw holes formed in one of said hinge plate and said face plate, and threaded screw holes being formed in the other of said hinge plate and said face plate so that said hinge plate and said face plate may be fastened together by screws; and adjustable slide stops carried by the fixture plate to locate the alignment fixture at a desired location relative to the cabinet box.

2. The device of claim 1 wherein said fixture plate includes a handle grip.

3. The device of claim 1 wherein said fixture plate includes adjustment slots for adjusting the positions of said slide stops.

4. The device of claim 3 including thumb screws secured with said slide stops for fixing said slide stops on said fixture plate in multiple positions.

5. The device of claim 4 including a scale marked on said fixture plate for locating a proper position of said slide stops on said fixture plate.

6. The device of claim 1 including a face plate carried by said fixture plate, said face plate includes at least one face stop for engaging the cabinet face to provide a clearance space for mounting the door hinge.

7. The device of claim 1 wherein two spaced face stops are carried by said face plate, and a recess is formed between said face stops.

8. The device of claim 7 including a hinge mounting plate secured to said door hinge on said fixture plate, said face stops engaging said cabinet face to space said door from the cabinet to form a desired clearance for the mounting of the hinge mounting plate.

9. The device of claim 6 wherein one of said face plate and fixture plate includes threaded screw holes and the other of said face plate fixture plate includes pass through screw holes so that said face plate and said fixture plate may be fastened together by means of screws.

10. The device of claim 9 wherein said face plate includes threaded screw holes for attaching said hinge plate to said fixture plate by means of screws.

11. The device of claim 1 wherein said hinge plate includes a circular opening for receiving a cup of the door hinge when mounted on said hinge plate.

12. The device of claim 11 wherein said face plate includes an arcuate section which corresponds to an arcuate section of said circular opening.

13. The device of claim 1 wherein threaded screw holes are formed in one of said fixture plate and face plate and pass through screw holes are formed in the other one said face plate and hinge plate so that the plates may be fastened together by screws.

14. The device of claim 1 including a plurality of different door hinge plates provided with said fixture plate for mounting different types of hinges.

15. A universal hinge alignment fixture for mounting different types of hinges to a cabinet have a cabinet box opening comprising:

a fixture plate;

a grip for holding said fixture plate during use;

a detachable hinge plate mount carried by said fixture plate for affixing different types of hinge plates to said fixture plate to operate with different types of hinges;

a face plate carried by said fixture plate for engaging a face of the cabinet surrounding said cabinet box opening and creating a hinge mounting space;

adjustable slide stops carried by said fixture plate for positioning said fixture plate in a proper position for affixing a hinge mounting plate to said cabinet;

adjusting slots formed in said fixture plate for adjusting the position of said slide stops on said fixture plate, a clamping arrangement having a first tightening part carried by said slide stops, and a second tightening part for engaging said first tightening part to set said slide stops in said proper position on said fixture plate;

a scale marked on said fixture plate for locating said slide stops; and whereby said hinge alignment fixture may be used to mount different types of hinges.

16. The device of claim 15 wherein said face plate includes a pair of face stops for engaging a face of said cabinet opening, and a recess defined between said face stops for receiving edges of a mounting plate being attached to the cabinet box.

17. The device of claim 16 wherein said hinge plate includes a circular cut out for receiving a cup of the door hinge when mounted to said hinge plate.

18. The device of claim 17 wherein said face plate includes an arcuate section matching an arcuate section of the circular cut out.

19. The device of claim 15 wherein said first tightening part includes a threaded screw hole and said second part includes a tightening screw received in said threaded hole.

* * * * *